US005674386A

United States Patent [19]

Filion

[11] Patent Number: 5,674,386

[45] Date of Patent: Oct. 7, 1997

[54] SELF-CLEANING BAR SCREEN FOR STORM WATER AND THE LIKE LARGE WATER VOLUMES

[75] Inventor: Gilles Filion, Kirkland, Canada

[73] Assignee: John Meunier Inc., Montréal, Canada

[21] Appl. No.: 664,041

[22] Filed: Jun. 13, 1996

[51] Int. Cl.[6] ..... E03F 5/14

[52] U.S. Cl. ..... 210/154; 210/162; 210/248; 210/407

[58] Field of Search ..... 210/154, 156, 210/162, 163, 164, 165, 166, 248, 407, 456, 474, 483; 404/2, 3, 4, 5; 209/273, 352, 393

[56] References Cited

U.S. PATENT DOCUMENTS

| | | | |
|---|---|---|---|
| 669,269 | 5/1901 | Wheeler | 210/163 |
| 2,117,887 | 5/1938 | Holland | 210/163 |
| 2,354,994 | 8/1944 | Holland | 404/5 |
| 3,089,396 | 5/1963 | Rowland | 210/163 |
| 3,451,555 | 6/1969 | Ginaven | 209/273 |
| 4,472,274 | 9/1984 | Williams | 210/163 |
| 4,968,170 | 11/1990 | Wilson et al. | 404/2 |
| 5,405,539 | 4/1995 | Schneider | 210/163 |
| 5,543,038 | 8/1996 | Johannessen | 210/154 |

*Primary Examiner*—Neil McCarthy
*Assistant Examiner*—Theodore M. Green
*Attorney, Agent, or Firm*—F. Martineau

[57] ABSTRACT

The screen comprises a set of spaced parallel grating bars set at an inclination of about 35 degrees. The grating bars retain solids carried by the water flowing between the bars. These solids are automatically pushed down the bars and away into a collecting trough transverse to the bars by water streams flowing within longitudinal grooves formed from the top of the bars. The cross-sectional area of each groove decreases from the upper end to the lower end of the bar, so that the water accelerating down the bar grooves will constantly fill the same.

15 Claims, 3 Drawing Sheets

SELF-CLEANING BAR SCREEN FOR STORM WATER AND THE LIKE LARGE WATER VOLUMES

FIELD OF THE INVENTION

The present invention relates to a self-cleaning bar screen for storm water and the like large water volumes carrying solids or suspended matters.

BACKGROUND OF THE INVENTION

It is known to provide a self-cleaning screen that is a screen which does not require any mechanical equipment as rotating or travelling rake for periodically cleaning the same from the solids filtered out of the water flowing through the screen bars.

In a known construction, the bars are set at an angle and the solids flow down the bars by gravity into a collecting trough disposed transverse to the lower end of the screen bars. However, it frequently happens that the solids fail to flow down the bars and rapidly clog the screen with the result that the screen is overpassed and the water is not properly screened, and will require more maintenance attention.

OBJECTS OF THE INVENTION

It is therefore the main object of the present invention to provide an improved self-cleaning bar screen of the character described in which screen clogging is eliminated.

Another object of the present invention is to provide such a self-cleaning which is devoid of any moving parts.

Another object of the present invention is to provide a bar screen of the character described of very simple and inexpensive construction, which will have a long useful life and which does not require any attention for its operation.

SUMMARY OF THE INVENTION

The present invention relates to a self-cleaning bar screen for storm water and the like large water volumes.

The gist of the invention is to provide an improved self-cleaning bar screen in which screen clogging is eliminated.

More particularly, the invention discloses a bar screen comprising a plurality of parallel spaced inclined bars having an upper end and a lower end, each bar being formed with a channel in the upstream edge face thereof, each channel having a cross-sectional area which decreases from said upper end to said lower end of the bar.

The invention furthermore discloses the combination of an inflow basin having a water inlet and a weir over the top of which the water is discharged and drops into an outflow basin, a solid collecting trough spaced from and generally parallel to said weir and at a level intermediate the level of said weir and the water level in said outflow basin, a bar screen extending between said weir top and said trough and including a plurality of inclined, spaced, parallel, straight screen bars each having an upper end fixed to said weir top and a lower end fixed to said trough, whereby water overflowing said weir drops into said outflow basin between said screen bars and while solids in said water are filtered out by said screen bars, each bar having an upstream edge face formed with a longitudinal channel for receiving water overflowing said weir and discharging the same into said trough, whereby the water flowing within said channels causes downward movement of said solids along said upstream edge faces of said bars and are discharged into said trough.

Preferably, the cross-sectional area of each channel decreases from said upper end to said lower end of the bar.

Preferably, the depth of the channel decreases while its width remains constant from the upper end to the lower end of the bar.

Advantageously, the rate of decrease of said cross-sectional area of said channel is constant from said upper end to said lower end of said bar.

Preferably, the rate of decrease of said depth is constant from said upper end to said lower end of said bar.

Advantageously, each screen bar has a progressively decreasing thickness from its upstream edge face to its downstream edge face.

Preferably, each channel has a flat bottom face and flat inner side faces.

Advantageously, the combination further includes a lip fixed to said weir top and overhanging said inflow basin.

Preferably, the ratio of the channel width over the bar thickness at said upstream edge face varies from ½ to ⅚.

DETAILED DESCRIPTION OF THE PREFERRED EMBODIMENT

Figure 1:
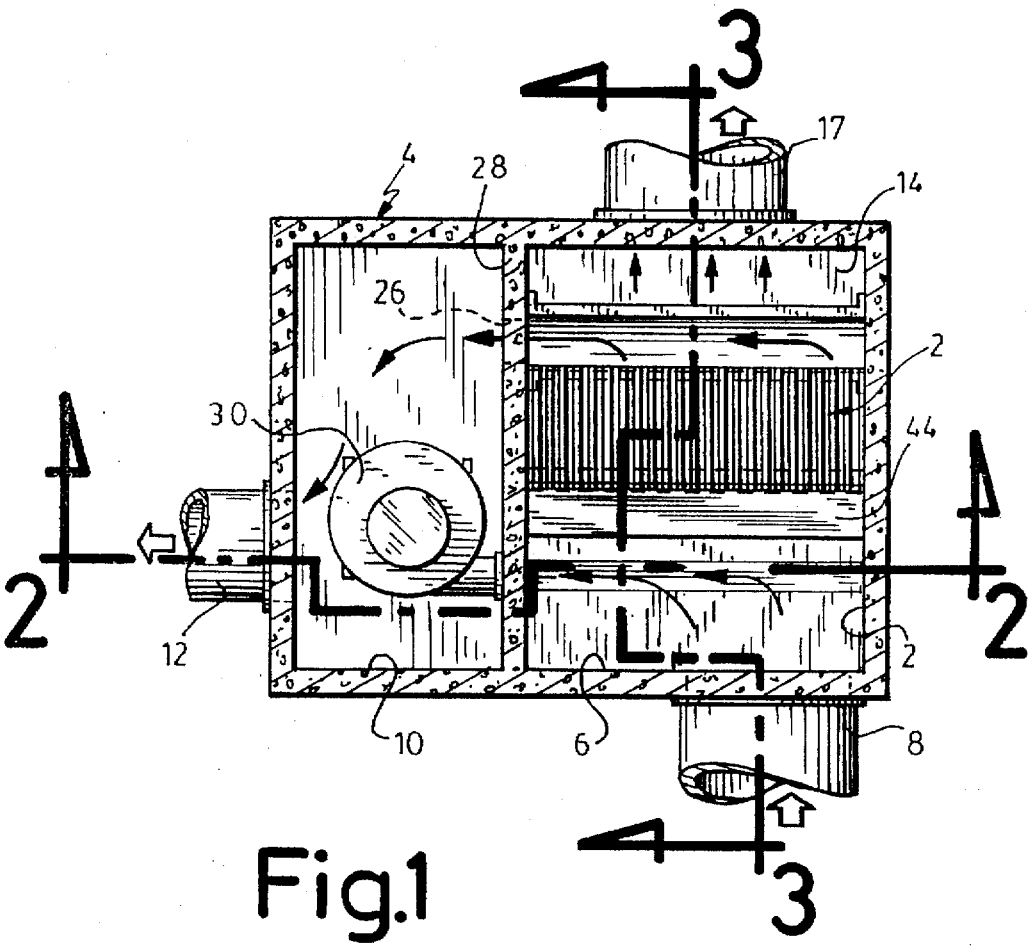
FIG. 1 is top plan section, taken along line 1—1 of FIG. 2, of an installation in which the self-cleaning screen is used for screening storm water.
Figure 2:
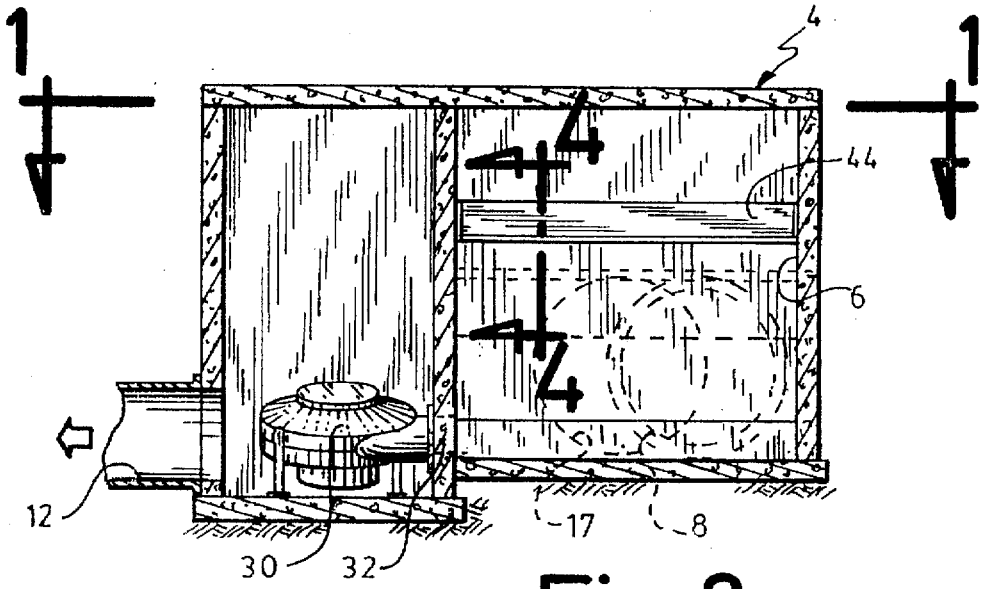
FIGS. 2 and 3 are vertical sections taken along lines 2—2 and 3—3 respectively of FIG. 1.
Figure 3:
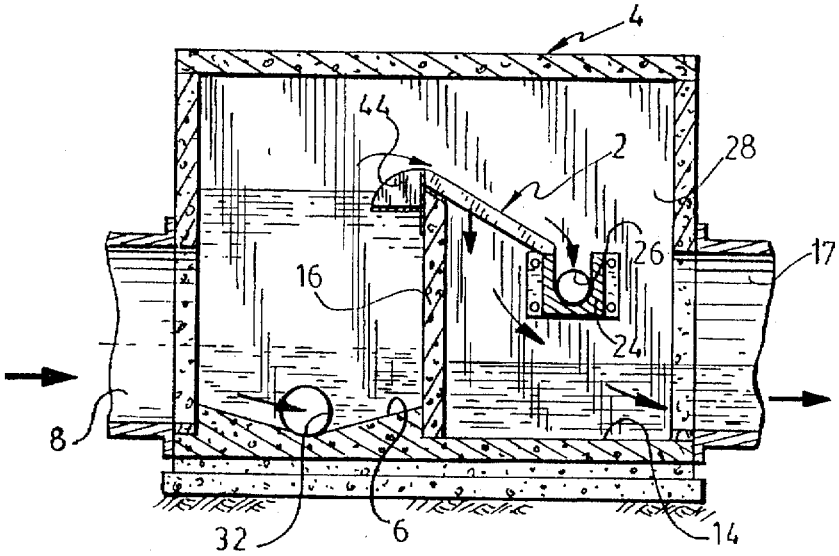

The bar screen 2 in accordance with the present invention is installed within a storm water screening assembly generally indicated at 4 and comprising an inflow basin 6 fed with rain water by an inlet pipe 8, the water network e.g. rain storm water having a sufficient capacity to accept water from a storm. Adjacent inflow basin 6 is a chamber 10 which is connected by an outlet pipe 12 to the sewer network. Inflow basin 6 is separated from an outflow basin 14 by a weir 16. Outflow basin 14 is connected to a storm water outlet pipe 17. Bar screen 2 is composed of a series of spaced, parallel straight screen bars 18 and intervening spacer blocks 23 secured together byte rods (or equivalent attachment means). Bars 18 are all coplanar and are vertically inclined, having their upper ends 20 secured to the top of weir 16 and their lower ends 22 secured over a trough 24 which extends transversely of the screen bars 18 and is adapted to collect the solids filtered out of the storm water flowing between the screen bars 18. Trough 24 is at a level intermediate the top of weir 16 and the maximum water level in basin 14. The solids moving down along bars 18 are collected by the trough 24 is directed into the chamber 10 through an opening 26 made in wall 28 separating the two basins 6 and 14 from sewer chamber 10.

In normal condition, the rate of flow of the water entering inflow basin 6 through storm water inlet pipe 8 is not sufficient to flow over weir 16. It simply enters a flow regulator 30 through the regulator inlet 32 at the bottom of inflow basin 6. The flow regulator discharges the water directly into the sewer chamber 10. The flow regulator is adjusted so that it controls the flow to an amount which is not above the flow capacity of the sewer network outlet pipe 12.

Whenever the flow rate of the water entering inflow basin 6 through inlet pipe 8 exceeds the controlled flow rate of the regulator, the water level within inflow basin 6 rises and the water flows over the top of weir 16 onto the upstream edge faces 34 of the screen bars 18. The water flows between the bars to be discharged to a river or the like by the storm water outlet pipe 17.

The solids filtered out of the storm water and resting on the upstream edge faces 34 of the screen bars 18 move down by gravity along the screen bars to be collected within the trough 24. In order to assist the solids in their downward movement towards the trough, the upstream edge faces 34 of each bar is provided with a longitudinally extending channel 36 opening at both the upper end 20 and lower end 22 of the bar 18. A portion of storm water flowing over the top of weir 16 enters the channels 36 and flows down these channels to be discharged into trough 24. It has been found that a downward moving water film is formed on the upstream edge faces 34 of the bars effectively carrying the screened solids into trough 24 therefore continuously effecting cleaning of the bar screen 2.

The water flowing down channels 36 serves also to transport the screened solids along trough 24 into sewer chamber 10.

Figure 6:
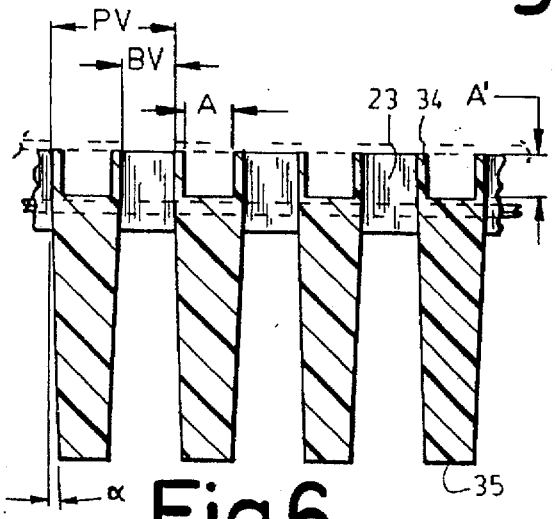
FIGS. 6, 7 and 8 are sections taken along lines 6—6, 7—7 and 8—8 respectively of FIG. 5.
Figure 7:
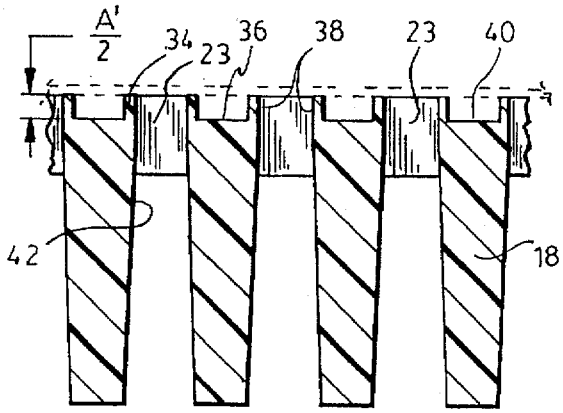

In one embodiment, as shown in cross-section in FIGS. 6 and 7, each channel 36 is of generally quadrangular cross-section defining straight parallel inner walls 38 and a straight bottom face 40. In an alternate embodiment (not shown), straight bottom face 40 could be made transversely concave to form a rounded surface merging with the straight inside faces 38.

Figure 8:
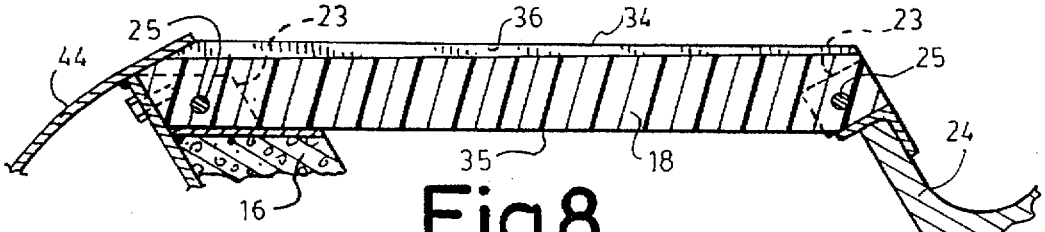

Preferably, the cross-sectional area of each channel 36 progressively decreases along the screen bar 18 from its upper end 20 to its lower end 22 so that the channel will remain filled with water along its entire length despite the fact that the water accelerates down the channel 36 due to the inclination of the screen bars 18. In practice, this progressively decreasing cross-sectional area is obtained by progressively decreasing the depth of the channel 36, as clearly shown in FIG. 8.

Figure 5:
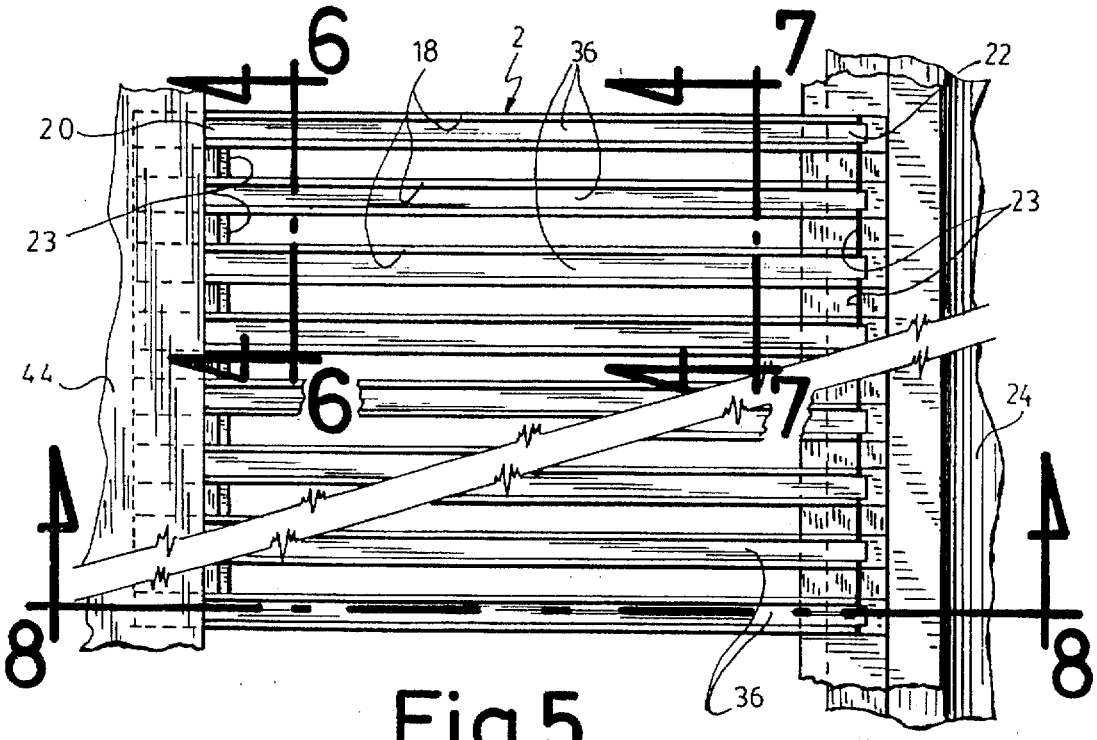
FIG. 5 is a top plan view taken along line 5 of FIG. 4.

The pitch between adjacent screen bars 18 may vary in accordance with the fineness of the solids to be filtered out, this pitch being indicated as a variable pitch PV in FIG. 6. This pitch is naturally composed of the maximum thickness of each bar plus the width of the interbars slots indicated at BV at FIG. 6, which is also variable. The height of each screen bar 18 together with its thickness will depend on the length of the screen bars 18 from the upper to the lower supported ends 20, 22. The width A of each channel 36 may vary and, as shown in FIGS. 6 and 7, the depth of the channel indicated at A' in section 6—6 of the screen bars 18 is about twice the channel depth in the area of the screen bars taken along line 7—7 of FIG. 5 and indicated as A'/2.

Preferably, each screen bar 18 is downwardly tapered, as indicated by angle $\alpha$ from its upstream edge face 34 to its downstream edge face 35. This facilitates clearing of the debris which might become trapped between the inter-bar slots 42.

Screen bars 18 are preferably extruded from a thermoplastic such as the Delrin P acetal resin sold by Dupont.

Figure 4:
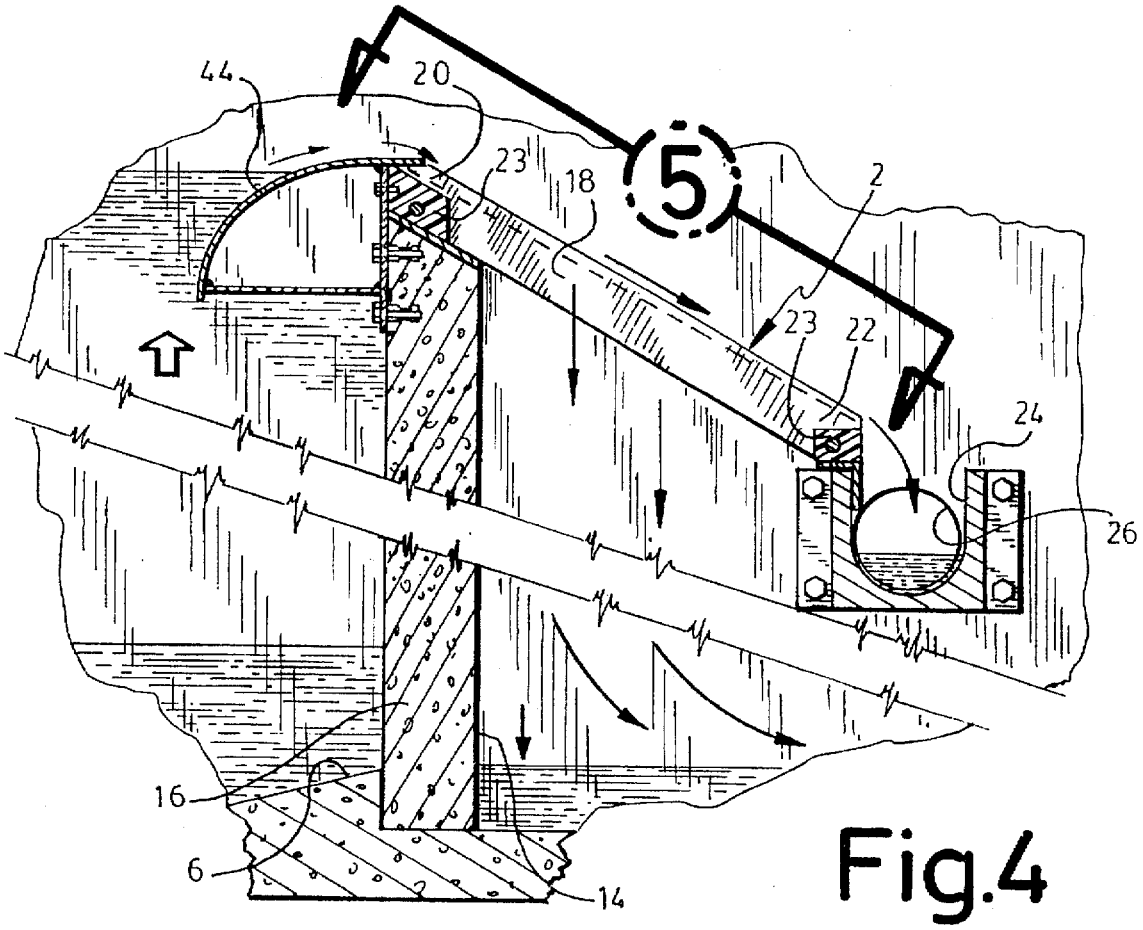
FIG. 4 is a vertical section at an enlarged scale taken along line 4—4 of FIG. 2.

Preferably, as shown in FIG. 4, the top edge of weir 16 is fitted with a lip 44 which extends inwardly over the inflow basin 6. It has been found that this lip 44 acts as a baffle or deflector which, in high water flow over the weir, prevents the water from shooting high over the weir 16 and land on the screen bars 18 in a zone spaced a substantial distance form their upper ends 20 so that all the upper portion of the bar screen will remain useless for filtering. With the lip 44, the water is caused to flow outwardly from the weir 16 then over the curved top of the lip to fall immediately adjacent the upper ends 20 of the screen bars 18. Thus the entire surface of the bar screen is effective for screening solids of the storm water. The width A of the channels 36 may vary between ½ and ⅚ of an inch. The following are typical dimensions of the screen bars 18 in relation to their maximum bar thickness and the width of their channels 36:

| Maximum bar thickness (in inches) | Channel width A (in inches) |
|---|---|
| 1/8 | 1/16 |
| 3/16 | 1/8 |
| 1/4 | 3/16 |
| 3/8 | 1/4 |
| 1/2 | 1/4 |
| 3/4 | 5/8 |

From this table, it is seen that the ratio of the channel width over the maximum bar thickness varies from ½ to ⅚. Obviously, for maximum bar self-cleaning efficiency, the ratio should be maximum.

The width of the interbar slots 42 is preferably ¼ of an inch, but will vary in accordance with the size of the solids to be removed from the water.

The preferred inclination of the bar screen 2 is between 30° and 45°. However, it is possible to vary the inclination between 15° to 75°.

Whenever is mentioned the word basin, it is envisioned to include any duct, conduit or other reservoir or tank capable of holding and retaining a volume of liquid, particularly water. Moreover, it is noted that the application of the present invention is not to be exclusively limited to the sewer waste water treatment industry, but could easily be expanded to other suitable industries, in particular the pulp and paper industry and the food processing industry.

The embodiments of the invention, in which an exclusive property or privilege is claimed, are defined as follows:

1. A bar screen comprising a plurality of parallel spaced, inclined bars having an upstream edge face and a downstream edge face and an upper end and a lower end, each bar being formed with a channel in the upstream edge face, each channel having a cross-sectional area which decreases from said upper end to said lower end of the bar in a direction perpendicular to a longitudinal axis of said channel.

2. A bar screen as defined in claim 1, wherein the depth of the channel decreases while its width remains constant from said upper end to said lower end of the bar.

3. A bar screen as defined in claim 1, wherein the rate of decrease of said cross-sectional area is constant from said upper end to said lower end of the bar.

4. A bar screen as defined in claim 2, wherein the rate of decrease of said depth is constant from said upper end to said lower end of the bar.

5. A bar screen as defined in claim 2, wherein the ratio of the channel width over the bar thickness at said upstream edge face varies from ½ to ⅚.

6. A bar screen as defined in claim 1, wherein each screen bar has a progressively decreasing thickness from said upstream edge face to said downstream edge face.

7. A bar screen as defined in claim 1, wherein each channel has a flat bottom face and flat inner side faces.

8. The combination of an inflow basin having an inlet for receiving water and a weir over the top of which the water is discharged and drops into an outflow basin, a solid collecting trough spaced from and generally parallel to said weir and at a level intermediate the level of said weir and the water level in said outflow basin, a bar screen extending between said weir top and said trough and including a plurality of inclined, spaced, parallel, straight screen bars each having an upper end fixed to said weir top and a lower end fixed to said trough, whereby water overflowing said weir drops into said outflow basin between said screen bars and while solids in said water are filtered out by said screen bars, each bar having an upstream edge face formed with a channel opened at both ends of said bar for receiving water overflowing said weir and discharging the same into said trough, wherein the cross-sectional area of each channel decreases from said upper end to said lower end of the bar in a direction perpendicular to a longitudinal axis of said channel, whereby the water flowing within said channels causes downward movement of said solids along said upstream edge faces of said bars and are discharged into said trough.

9. The combination as defined in claim 8, wherein the depth of the channel decreases while its width remains constant from the upper end to the lower end of the bar.

10. The combination as defined in claim 9, wherein the rate of decrease of said depth is constant from said upper end to said lower end of said bar.

11. A bar screen as defined in claim 9, wherein the ratio of the channel width over the bar thickness at said upstream edge face varies from ½ to ⅚.

12. The combination as defined in claim 8, wherein the rate of decrease of said cross-sectional area of said channel is constant from said upper end to said lower end of said bar.

13. The combination as defined in claim 8, wherein each screen bar has a progressively decreasing thickness from its upstream edge face to its downstream edge face.

14. A bar screen as defined in claim 8, wherein each channel has a flat bottom face and flat inner side faces.

15. The combination as defined in claim 8, further including a lip fixed to said weir top and overhanging said inflow basin.

* * * * *